United States Patent [19]

Jansson et al.

[11] Patent Number: 4,473,108

[45] Date of Patent: Sep. 25, 1984

[54] HEAT EXCHANGERS

[75] Inventors: Lennart Jansson, Huskvarna; Stellan Åkesson; Harry Waermö, both of Jönköping, all of Sweden

[73] Assignee: Flakt Aktiebolag, Nacka, Sweden

[21] Appl. No.: 345,584

[22] Filed: Feb. 4, 1982

[30] Foreign Application Priority Data

Feb. 9, 1981 [SE] Sweden ..... 8100873

[51] Int. Cl.[3] ..... F23L 15/02

[52] U.S. Cl. ..... 165/8; 165/78

[58] Field of Search ..... 165/78, 8, 9, 53, 68, 165/162; 108/93; 248/172, 670

[56] References Cited

U.S. PATENT DOCUMENTS

| | | | |
|---|---|---|---|
| 2,143,157 | 1/1939 | Kotzebue | 165/82 |
| 2,615,687 | 10/1952 | Simmons | 165/78 |
| 2,738,027 | 3/1956 | Winklepleck | 165/5 |
| 2,874,939 | 2/1959 | Rahr et al. | 165/9 |
| 3,276,515 | 10/1966 | Whitfield | 165/8 |
| 3,447,598 | 6/1969 | Kaess | 165/82 |
| 3,871,442 | 3/1975 | Finnemore | 165/8 |
| 4,019,568 | 4/1977 | Brzytwa | 165/8 |
| 4,063,587 | 12/1977 | Stockman | 165/8 |
| 4,066,119 | 1/1978 | Stedman | 165/86 |
| 4,093,435 | 6/1978 | Marron et al. | 165/10 |

FOREIGN PATENT DOCUMENTS

| | | | |
|---|---|---|---|
| 2064085 | 6/1981 | United Kingdom | 165/8 |

*Primary Examiner*—Sheldon J. Richter
*Assistant Examiner*—John F. McNally
*Attorney, Agent, or Firm*—Dann, Dorfman, Herrell and Skillman

[57] ABSTRACT

A heat exchanger for the extraction and re-use of heat and/or moisture from gas flows comprising: a housing (3) forming a duct section for gas flows; a rotor (7) which has a plurality of air passages extending therethrough; and a guide arrangement (9, 10, 11) for carrying the rotor (7), which arrangement is movable laterally of the housing (3) to carry the rotor (7) between an inserted position and an at least partially extracted position. A drive (21) for driving the rotor (7) can be movable jointly with said rotor (7). In an expedient embodiment, the rotor bearing is located, optionally together with the drive, on a support member (10, 11) which is stiff against both torsion and bending and which is movable on guide rails. This support member extends expediently by means of two carrying members (10) next to the two major faces of said rotor (7), which are movable on said rails in the housing (3).

9 Claims, 7 Drawing Figures

HEAT EXCHANGERS

The present invention relates to heat exchangers.

Rotating heat exchangers are often used in ventilation installations for the extraction and reuse of heat and/or moisture from exhaust air. The active part of the heat exchanger, the rotor, is designed with axial ducts which allow the passage of the air. To adapt to differing air quantities, the rotor is manufactured with varying diameters between 500 mm and 5000 mm. Even where the demands on efficiency are very high, the rotor can be kept very short in the axial direction, usually about 200 mm.

The rotor is surrounded by and suspended in a duct-forming casing, which has connections to a source of fresh air and for the exhaust air before and after its flow through the heat exchanger. To prevent complete mixing of fresh air and exhaust air in the casing, it is necessary that the rotor has effective seals, both along the rotor diameter between the two connected ducts and around the rotor periphery. These seals have to be provided on both sides of said rotor. Due to the small dimensions of the rotor in the axial direction, the great advantage is achieved that the complete heat exchanger can be very short in length.

As a result of the fact that the heat exchanger works according to the counterflow principle, the fresh air and exhaust air flows moving in opposite directions cause a turning moment which seeks to place the rotor at an inclination to the casing and to its seals. This turning moment increases very quickly with the increasing rotor diameter. Simultaneously the demands placed on a stable rotor bearing caused by the geometric factor, i.e. the ratio between the rotor diameter and the heat exchanger length, also increase. The tightness of the sealing of the heat exchanger against leakage is substantially worsened in proportion to the degree of inclination of the rotor.

For this reason, the rotor bearing in the casing has to be secured against inclined positions. Conventionally therefore, the heat exchanger is made with a fully welded framework which has up to four beams, which meet in the centersection. Further reinforcements of the framework are attained by diagonal struts. The casing coverplates are either welded or screwed onto the framework. On this fixed framework the rotor bearing intended for the rotatable suspension of the rotor is secured by welding or with bolts.

Because of the use of this type of rotor suspension, both inspection and maintenance and repair have to be carried out from the interior of the duct system. Apart from certain simple checks on the rotor surfaces as well as possible adjustments to the seals, the maintenance work is difficult and frequently not without its dangers, because it has to be carried out in narrow and often sloping duct sections. This applies to activities such as cleaning, exchange of sector parts or the replacement of the bearings.

An object of the invention is to provide a heat exchanger in which access to the rotor is simplified without danger of the rotor assuming unduly inclined positions in the casing.

According to the invention, there is provided a heat exchanger for the extraction and re-use of heat and/or moisture from gas flows, comprising: a housing forming a duct section for gas flows; a rotor which has a plurality of air passages extending therethrough; and a guide arrangement for carrying the rotor, which arrangement is movable laterally of the housing to carry the rotor between an inserted position and an at least partially extracted position.

Preferably, mounted on said guide arrangement for movement therewith there is provided a drive for the rotor.

Preferably, bearings for the rotor and the drive are provided on a common movable support member of said guide arrangement.

Preferably, said support member comprises two carrying members which are rigidly interconnected by a cross-member and which extend adjacent to the two major faces of the rotor and are movable on or in guides provided in said housing.

The guide arrangement preferably comprises at least one sidewall of said housing supported by said movable support member.

Said guide may consist of rails on or in which said carrying members are mounted for sliding or rolling.

Preferably, when provided, said rails are rigidly interconnected by a cross-member and form therewith a guide member, which together with the support member forms a bearing frame which is relatively stiff against torsion and bending.

Expediently, said rails are rigidly secured to the housing and together with the carrying members guided thereon and with the cross-member connecting them, form an assembly which is relatively stiff against torsion and bending.

For a better understanding of the invention and to show how the same may be carried into effect, reference will now be made, by way of example, to the accompanying drawings, in which.

Figure 1:
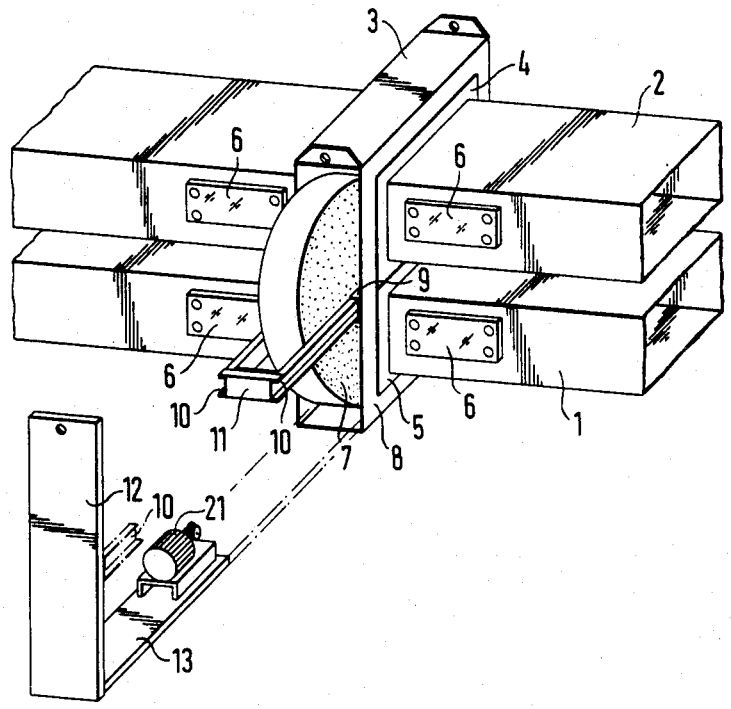
FIG. 1 shows a perspective view of a heat exchanger with its connected ducts for fresh air and for exhaust air, with the rotor partially removed from the exchanger casing.

FIG. 1 clearly shows the arrangement of a heat exchanger in a pair of ducts 1 and 2 for fresh and exhaust air.

By means of connector supports 4 and 5 arranged on its housing 3, the heat exchanger is connected to the two ducts 1 and 2, which each have inspection windows 6 on both sides of the heat exchanger.

FIG. 1 shows a rotor 7 of this heat exchanger in a position partially extracted from the housing 3 in a direction perpendicular to the axis of the ducts. To achieve the extraction, a guide rail 9 is arranged on each of the two sidewalls 8 of the exchanger housing 3, in which a support member 10, 11 for the rotor 7 is mounted for longitudinal displacement. This support member 10, 11 consists of two rods, bars or beams forming carrying members 10 and located adjacent respective major faces of said rotor, while these members 10 are interconnected at their ends by a cross-member 11. A support for the rotatable bearing of the rotor is secured on these bars or beams 10. To the said support member 10, 11, a front sidewall 12 of the housing 3 of the heat exchanger is connected, and to it a bridge 13 is secured on which the drive motor 21 for the rotor 7 is mounted. FIG. 1 shows the front sidewall 12 of the housing 3, with its bridge 22 and the motor 21, detached from the support member formed by the carrying members 10 and the cross-member 11, in order to make clear the details of said heat exchanger. In this figure, the connection of the motor 21 with the shaft of the rotor 7 is not shown. Furthermore, although not illustrated in the figures, rotor 7 is provided with the usual throughgoing channels parallel to its rotation axis for passage of the gas in each duct 1 and 2.

Figure 2:
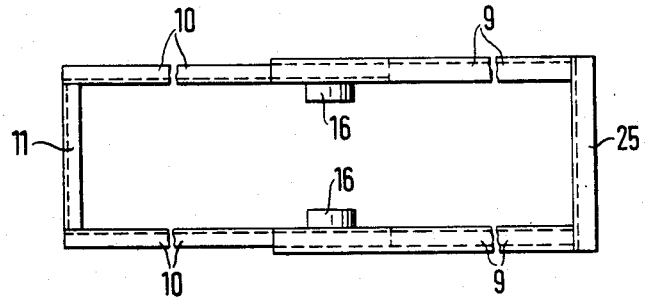
FIG. 2 shows a side view of a guide device and a support member displaceable thereon for the rotor and its drive.

FIG. 2 shows the arrangement of the bearing 16 for the shaft of rotor 7 on the two opposed inner sides of the lateral carrying members 10 of the support member. In the embodiment shown in FIG. 2, the guide rails 9 which are intended for the movable and guided arrangement of the lateral members 10 are also connected by a cross-member 25, which is positioned opposite the above-mentioned cross-member 11. These guide rails 9 form, together with the cross-member 25, the guide member for the rotor and for its drive device, which guide member is secured immovably in housing 3.

Figure 3:
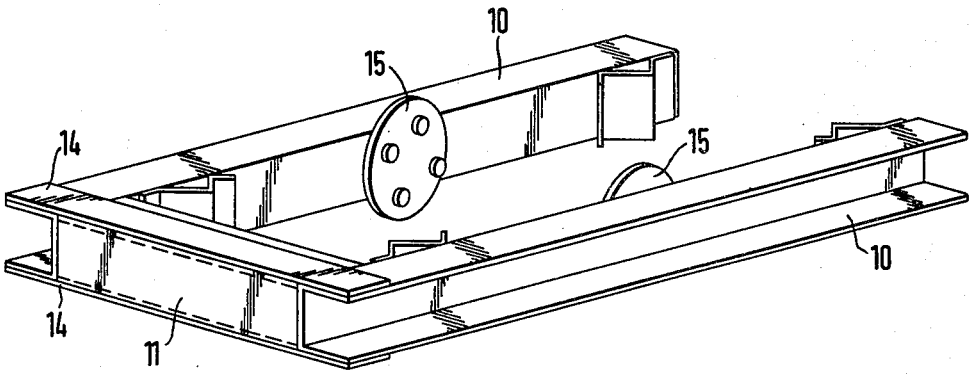
FIG. 3 shows a perspective view of the support member at a larger scale.

In the larger-scale illustration of FIG. 3, the support member is shown with its members 10 having U-shaped cross-section with their open sides facing away from each other. The cross-member 11 also has a U-shaped cross-section and is connected with torsional strength to the two members 10. This is achieved in the illustrated embodiment by means of connecting bars 14.

Figure 4:
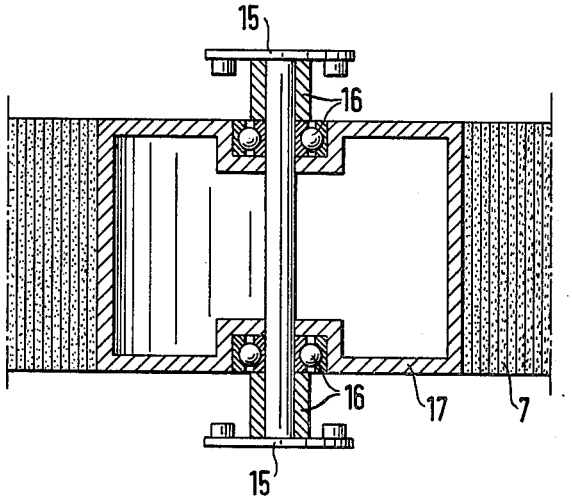
FIG. 4 shows an axial section through the center portion of the rotor and its bearing.

On their inner sides facing each other the members 10 carry circular disks 15, on which bearings 16 (see FIG. 4) for the rotatable bearing of the hub 17 of the rotor 7 are secured.

Figure 5:
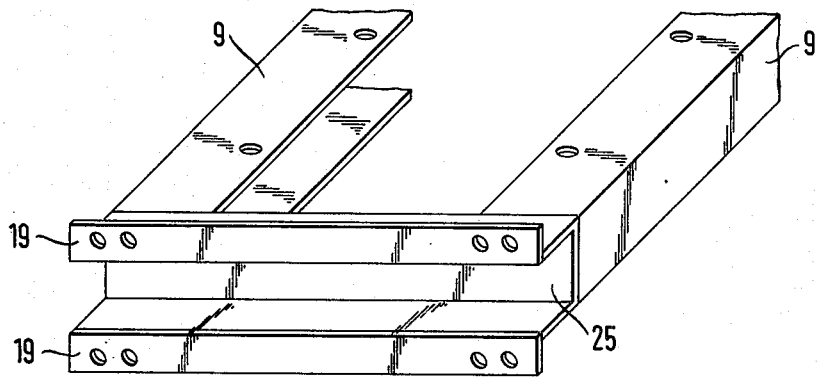
FIG. 5 shows a perspective view of the guide device for the support member at the same scale as FIG. 3.

FIG. 5 shows on a larger scale the stationary guide member shown schematically in FIG. 2. In this guide member the two lateral guide-rails 9 also have U-shaped cross-section and in this case have their open sides facing each other, so that they can accept the members 10 of the support member 11 there between. The cross-member 25 connecting these guide-rails 9 also has a U-shaped cross section and has its open side facing away from rails 9. On the edges of this open side, this channel member 25 has an outwardly-oriented flange 19, by means of which the guide member 9, 25 is secured to the housing 3. But is is also possible that the lateral rails can be secured directly on casing 3 of the heat exchanger. This fixture can be made either by welding or by screws.

Of course, the channel members of the members 10 of the support member and of rails 9 of the guide member have to be dimensioned so that the members 10 are guided with sliding or rolling motion in rails 9, substantially without the occurence of any tilting of the rotor about its rotational axis or around an axis extending perpendicularly to said rotational axis. (For rolling motion, rollers could be provided on supported member 10, 11 or in rails 9).

Figure 6:
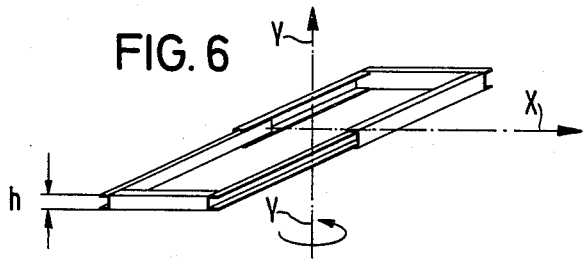
FIG. 6 illustrates schematically the guide and the extracted support member, and shows that these two parts of the heat exchanger supplement each other to form an exceptionally bend-resistant bearing unit.

Due to the inserted arrangement of support member 10, 11 in guide member 9, 25, these two members form a closed frame (see FIG. 2) having great torsional and bending resistance against rotation moments about the axis Y-Y shown in FIG. 6. To achieve an equally great stiffness in the Z-direction in FIG. 6, the beams or bars or rails of these two members are designed by the selection of the height h to have a suitable moment of inertia. An additional increase in this stiffness can be attained by the use of struts 20, as shown e.g. in FIG. 7. The Z-axis extends at right angle to the Y- and X-axis. Thus an important feature of the illustrated heat exchanger is that the rotor 7 is mounted on a guide arrangement for extraction from the housing laterally. In the embodiment shown, for this purpose the bearings 16 are located on a bifurcated support member 10, 11 in the form of a beam design which is torsionally and deflectionally resistant and which extends on both sides of rotor 7. This support member is guided fitting snugly in a guide member 9, 25 having also a bifurcated beam design which is torsionally and deflectionally resistant.

Although not illustrated, it is also possible for the drive 21 for the rotor to be permanently secured in the casing 3 and for the rotor 7 to be moved into and out of driving engagement therewith as it is inserted into and extracted from casing 3 on the support member 10, 11. In this case, of course, bridge 13 is not required.

Preferably, the rotor 7 is fully extractable from casing 3 by lateral movement supported in its support member 10, 11. However, in certain cases, and within the scope of the invention, the rotor may need to be only partially extracted when in its laterally displaced position.

Thus, summarizing the above, the rotor with its bearings is movable on or in a guide arranged in the housing laterally of the duct axis out of and into said housing. Here the rotor drive can be movable jointly with the rotor. For this purpose the rotor bearing and the drive for the rotor can be located jointly on a support member movable on or in said guide. This support member can have rods, bars or beams which are interconnected by at least one cross-member and which extend laterally to the two major faces of the rotor and are movable in or on guides arranged there. The guides can consist of rails arranged beside the two front faces of the rotor, on or in which the rods, bars or beams of the support member are slidingly mounted or are able to roll.

Figure 7:
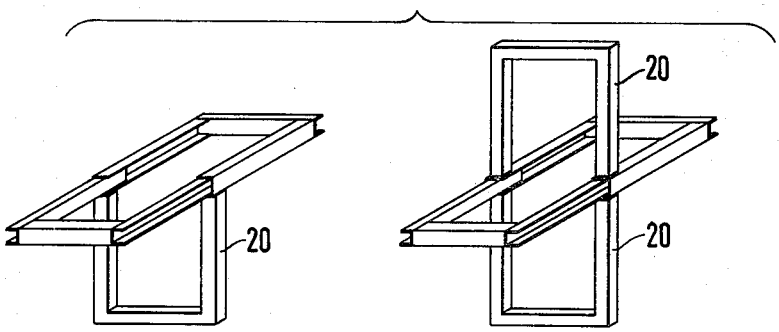
FIG. 7 shows schematically possibilities for further increase of the bending resistance of the unit of FIG. 6.

Diameter- and/or periphery-seals (not shown) are preferably attached to the support member, directly or indirectly, and are moveable together with the rotor. FIGS. 2–7 are, of course, to be understood such that the bearings 16 in the inserted position of the support member are spaced from cross-member 25 at least corresponding to the radius of the rotor 7. The struts 20 can in a special case be provided as shown in FIG. 7. Normally, they extend from the central part of the rails 9.

We claim:

1. A heat exchanger for the extraction and reuse of heat and/or moisture from gas flow comprising: a housing forming at least one duct section for gas flow; a rotor which has a plurality of air passages extending therethrough, said rotor having a plurality of parts, in the operative position of said rotor, each part adapted to register with said duct section in sequence upon rotation of said rotor, so that the gas flow flows through the passages in said registering part of the rotor; bearings mounting said rotor for rotation in said housing so as to displace said registering part out of registry with said duct section and another of said parts into registry with said duct section, drive means to rotate said rotor and displace said rotor parts; and a guide assembly carrying the rotor and the rotor bearings, which assembly is movable laterally of the housing to carry the rotor between its operative position and an inoperative position in which said rotor is a least partially extracted from said housing, said guide assembly including a movable frame surrounding and supporting said rotor and said bearings, said housing having support means receiving said frame and affording said lateral movement of the assembly.

2. A heat exchanger according to claim 1, wherein said frame comprises a first hollow rectangular framework enclosing said rotor and its bearings, and said support means has struts forming a second hollow rectangular framework perpendicular to said first framework.

3. A heat exchanger according to claim 1 wherein said housing comprises two duct sections and rotation of said rotor displaces the rotor part out of registry with one of said sections and into registry with the other of said sections, said guide arrangement being positioned between said duct section so that it does not interfere with the paths of gas flow through the respective sections.

4. A heat exchanger according to claim 1, wherein bearings for the rotor and the drive means are provided on and within the outline of the common movable frame, whereby said drive means is in engagement with said rotor during said lateral movement.

5. Heat exchanger according to claim 4, wherein said support frame comprises two carrying members which are rigidly interconnected by a cross-member and which extend adjacent to the two major faces of the rotor and are movable on said support means of said housing.

6. A heat exchanger according to claim 5, wherein said guide assembly comprises at least one sidewall supported by said movable frame, said side wall in the operative position of said rotor comprising a part of said housing.

7. A heat exchanger according to claim 5, wherein said support means comprise rails which mount said carrying members for sliding or rolling displacement.

8. A heat exchanger according to claim 7, wherein the rails are rigidly interconnected by a cross-member and from therewith a guide member for said frame, said rails, carrying members and cross-members comprising channel pieces of U-shaped cross section which are nested together to form a bearing frame which is relatively stiff against torsion and bending.

9. A heat exchanger according to claim 7, wherein said rails are rigidly secured to the housing, said rails, carrying members and cross-members comprising channel pieces of U-shaped cross section which are nested together to form an assembly which is relatively stiff against torsion and bending.

* * * * *